US010167872B2

(12) United States Patent
Davidson et al.

(10) Patent No.: US 10,167,872 B2
(45) Date of Patent: Jan. 1, 2019

(54) SYSTEM AND METHOD FOR OPERATING A COMPRESSOR

(71) Applicant: General Electric Company, Schenectady, NY (US)

(72) Inventors: Dwight Eric Davidson, Greer, SC (US); Paul Griffin Delvernois, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/195,081

(22) Filed: Jun. 28, 2016

(65) Prior Publication Data

US 2016/0305437 A1 Oct. 20, 2016

Related U.S. Application Data

(63) Continuation of application No. 12/956,461, filed on Nov. 30, 2010, now abandoned.

(51) Int. Cl.
*F01D 17/12* (2006.01)
*F04D 27/02* (2006.01)
(Continued)

(52) U.S. Cl.
CPC ..... *F04D 27/002* (2013.01); *F04D 27/0246* (2013.01); *F04D 29/321* (2013.01); *F04D 29/522* (2013.01); *F04D 29/563* (2013.01)

(58) Field of Classification Search
CPC ... F04D 27/002; F04D 27/0246; F04D 29/563
(Continued)

(56) References Cited

U.S. PATENT DOCUMENTS 2,613,029 A * 10/1952 Wilde ..... F04D 27/0246 415/147
3,392,909 A 7/1968 Turner
(Continued)

FOREIGN PATENT DOCUMENTS

JP 5139207 Y1 9/1976
JP 62-203998 A 9/1987
(Continued)

OTHER PUBLICATIONS

Unofficial English Translation of Japanese Office Action issued in connection with corresponding JP Application No. 2011256885 dated Sep. 27, 2016.
(Continued)

*Primary Examiner* — Woody Lee, Jr.
*Assistant Examiner* — Brian O Peters
(74) *Attorney, Agent, or Firm* — Charlotte C. Wilson; Ernest G. Cusick; Frank A. Landgraff

(57) ABSTRACT

A compressor includes a first stage of stator vanes having a first position and a second group of stator vanes arranged in two or more stages downstream from the first stage of stator vanes, each stage having a respective second position. A first actuator is engaged with the first stage of stator vanes, and a second actuator is engaged with a bar connecting the second group of stator vanes. A method for operating a compressor includes adjusting a first position of a first plurality of stator vanes and adjusting the respective second positions of a second group of stator vanes separately from the first position of the first stage of stator vanes.

18 Claims, 5 Drawing Sheets

(51) Int. Cl.

| | |
|---|---|
| ***F04D 29/56*** | (2006.01) |
| ***F04D 27/00*** | (2006.01) |
| ***F04D 29/32*** | (2006.01) |
| ***F04D 29/52*** | (2006.01) |

(58) Field of Classification Search
USPC ..... 415/149.2
See application file for complete search history.

(56) References Cited

U.S. PATENT DOCUMENTS

| | | | | |
|---|---|---|---|---|
| 3,779,665 | A | 12/1973 | Tatem, Jr. et al. | |
| 3,861,822 | A | 1/1975 | Wanger | |
| 3,914,066 | A | 10/1975 | Downing | |
| 4,102,604 | A | 7/1978 | Rutshtein et al. | |
| 4,874,287 | A | 10/1989 | Grieb | |
| 4,978,280 | A | 12/1990 | Tubbs | |
| 5,024,580 | A | 6/1991 | Olive | |
| 5,042,245 | A | 8/1991 | Zickwolf, Jr. | |
| 5,044,879 | A | 9/1991 | Farrar | |
| 5,281,087 | A | 1/1994 | Hines | |
| 5,346,360 | A | 9/1994 | Cooper | |
| 5,586,857 | A | 12/1996 | Ishii et al. | |
| 5,993,152 | A | 11/1999 | Schilling | |
| 6,234,061 | B1 | 5/2001 | Glasson | |
| 6,310,022 | B1 * | 10/2001 | Amiran | C11D 1/72 134/2 |
| 6,328,526 | B1 * | 12/2001 | Seki | F02C 7/26 415/1 |
| 6,402,487 | B1 | 6/2002 | Clements et al. | |
| 6,466,858 | B1 | 10/2002 | Adibhatla et al. | |
| 6,530,210 | B2 | 3/2003 | Horii et al. | |
| 6,551,057 | B1 | 4/2003 | Haaser et al. | |
| 6,553,768 | B1 | 4/2003 | Trewin et al. | |
| 6,584,762 | B2 | 7/2003 | Snow et al. | |
| 6,701,716 | B2 | 3/2004 | Rayer et al. | |
| 6,758,044 | B2 | 7/2004 | Mannarino | |
| 6,763,664 | B2 | 7/2004 | Aoyama | |
| 6,794,766 | B2 | 9/2004 | Wickert et al. | |
| 6,823,675 | B2 | 11/2004 | Brunell et al. | |
| 7,096,657 | B2 | 8/2006 | Mahoney et al. | |
| 7,111,464 | B2 | 9/2006 | Rowe | |
| 7,188,019 | B2 | 3/2007 | Nomura et al. | |
| 7,232,287 | B2 | 6/2007 | Regunath | |
| 7,393,178 | B2 | 7/2008 | Bouru | |
| 7,422,414 | B2 | 9/2008 | Fujii et al. | |
| 7,572,105 | B2 | 8/2009 | Columbus et al. | |
| 7,690,889 | B2 | 4/2010 | Giaimo et al. | |
| 7,762,084 | B2 | 7/2010 | Martis et al. | |
| 7,927,067 | B2 | 4/2011 | Rajamani et al. | |
| 7,934,902 | B2 | 5/2011 | Suciu et al. | |
| 8,075,253 | B2 | 12/2011 | Bertino | |
| 8,087,870 | B2 | 1/2012 | Flucker et al. | |
| 8,109,073 | B2 | 2/2012 | Foster et al. | |
| 8,348,600 | B2 | 1/2013 | Norris et al. | |
| 8,376,693 | B2 | 2/2013 | Gilman et al. | |
| 8,403,621 | B2 | 3/2013 | Guemmer | |
| 8,419,717 | B2 | 4/2013 | Diolaiti et al. | |
| 8,474,268 | B2 | 7/2013 | Fuller et al. | |
| 8,479,523 | B2 | 7/2013 | Berry | |
| 8,516,829 | B2 | 8/2013 | Ewens et al. | |
| 8,641,367 | B2 | 2/2014 | Norris et al. | |
| 8,740,548 | B2 | 6/2014 | Rowe | |
| 8,770,912 | B2 | 7/2014 | Minto et al. | |
| 8,834,103 | B2 * | 9/2014 | Hirokawa | F04D 29/563 415/160 |
| 9,022,747 | B2 | 5/2015 | Fletcher et al. | |
| 9,068,470 | B2 | 6/2015 | Mills et al. | |
| 9,341,076 | B2 | 5/2016 | Rowe et al. | |
| 2010/0189549 | A1 | 7/2010 | Gilman et al. | |
| 2011/0197593 | A1 | 8/2011 | Fuchs et al. | |
| 2012/0039706 | A1 | 2/2012 | Selmeier et al. | |
| 2012/0134783 | A1 | 5/2012 | Davidson et al. | |

FOREIGN PATENT DOCUMENTS

| | | | | |
|---|---|---|---|---|
| JP | 11-210699 | A | 8/1999 | |
| JP | 2003013748 | A | 1/2003 | |
| JP | 2005291184 | A | 10/2005 | |
| JP | 2006138250 | A | 6/2006 | |
| WO | WO2010097850 | * | 8/2010 | F04D 29/563 |

OTHER PUBLICATIONS

English translation of Request for Invalidation of Chinese Patent No. 201210138743.6 (equivalent of U.S. Pat. No. 9,068,470), which was filed with the Patent Reexamination Board of the Patent Office of the the State Intellectual Property Office of the People's Republic of China dated Mar. 13, 2018.

* cited by examiner

SYSTEM AND METHOD FOR OPERATING A COMPRESSOR

CROSS-REFERENCE TO RELATED APPLICATIONS

The present application is a continuation of co-pending U.S. patent application Ser. No. 12/956,461, filed Nov. 30, 2010, the entire disclosure of which is hereby incorporated by reference herein.

FIELD OF THE INVENTION

The present invention generally involves a system and method for operating a compressor. In particular embodiments of the present invention, the system and method may independently vary the position of stator vanes in different stages.

BACKGROUND OF THE INVENTION

Gas turbines are widely used in industrial and commercial operations. A typical gas turbine includes an axial compressor at the front, one or more combustors around the middle, and a turbine at the rear. The compressor generally includes alternating stages of circumferentially mounted stator vanes and rotating blades. The stator vanes typically attach to a casing surrounding the compressor, and the rotating blades typically attach to a rotor inside the compressor. Ambient air enters the compressor, and each stage of stator vanes directs the airflow onto the following stage of rotating blades to progressively impart kinetic energy to the working fluid (air) to bring it to a highly energized state. The working fluid exits the compressor and flows to the combustors where it mixes with fuel and ignites to generate combustion gases having a high temperature, pressure, and velocity. The combustion gases exit the combustors and flow to the turbine where they expand to produce work. For example, expansion of the combustion gases in the turbine may rotate a shaft connected to a generator to produce electricity.

During various operating conditions, it may be desirable to adjust the angle of the stator vanes with respect to an axial centerline of the compressor. For example, the stator vanes may be aligned further from the axial centerline of the compressor to suppress the onset of compressor stall at lower rotational speeds associated with start up or shutdown of the compressor. Conversely, the stator vanes may be aligned closer to the axial centerline of the compressor to allow more working fluid to flow through the compressor and increase the power output of the gas turbine during heavy or sudden increases in electrical demand on the generator.

U.S. Pat. Nos. 5,281,087; 6,551,057; and 6,794,766, assigned to the same assignee as the present application, disclose an electromechanical or hydraulic system for varying the position of stator vanes. In each patent, a single actuator connects to multiple stages of stator vanes to vary the position of the stator vanes with respect to the axial centerline of the compressor. However, the length and width of the stator vanes generally decreases along the axial length of the compressor. As a result, the length of travel for both the actuator and the stator vanes varies by stage. In addition, the cumulative manufacturing tolerances associated with both the actuator and the stator vanes increases proportionally as the size of the stator vanes increases. Therefore, the ability to precisely position stator vanes in different stages using a single actuator is difficult, and a system and method for independently varying the position of stator vanes in different stages would be useful.

BRIEF DESCRIPTION OF THE INVENTION

Aspects and advantages of the invention are set forth below in the following description, or may be obvious from the description, or may be learned through practice of the invention.

One embodiment of the present invention is a compressor that includes a first plurality of stator vanes having a first position and a second plurality of stator vanes, downstream from the first plurality of stator vanes, having a second position. The compressor further includes first means for adjusting the first position of the first plurality of stator vanes separately from the second position of the second plurality of stator vanes and second means for adjusting the second position of the second plurality of stator vanes separately from the first position of the first plurality of stator vanes.

Another embodiment of the present invention is a compressor that includes a first stage of stator vanes having a first position and a second stage of stator vanes downstream from the first stage of stator vanes having a second position. A first actuator is engaged with the first stage of stator vanes, and a second actuator is engaged with the second stage of stator vanes.

The present invention may also include a method for operating a compressor. The method includes adjusting a first position of a first plurality of stator vanes and adjusting a second position of a second plurality of stator vanes separately from the first position of the first plurality of stator vanes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
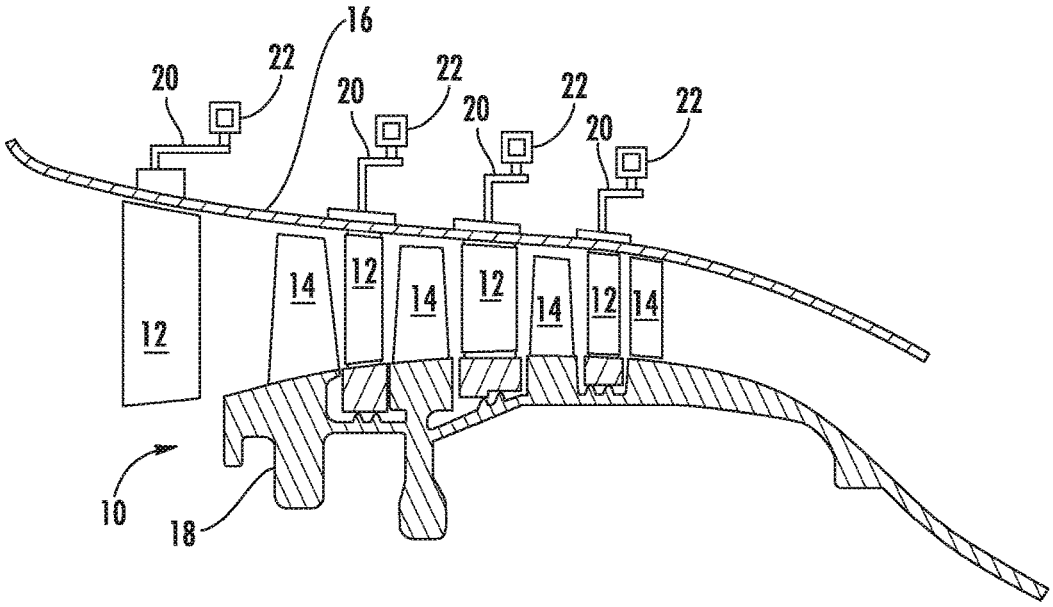
FIG. 1 is a simplified cross-section view of a compressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments within the scope of the present invention provide a system and method for varying the position of stator vanes in a compressor. In particular embodiments, the system may adjust the position of stator vanes in one stage separately and/or independently from the position of stator vanes in another stage. As a result, embodiments of the present invention provide one or more aerodynamic, mechanical, and/or control benefits over existing variables stator vanes systems.

FIG. 1 provides a simplified cross-section view of a compressor 10 according to one embodiment of the present invention. The compressor 10 generally includes alternating stages of stator vanes 12 and rotating blades 14 as is known in the art. The first stage of stator vanes 12 is commonly referred to as the inlet guide vane, and the rotating blades 14 and stator vanes 12 generally progressively decrease in length and width along the axial length of the compressor 10 downstream from the inlet guide vane. Each stage of stator vanes 12 and rotating blades 14 generally comprises a plurality of circumferentially arranged airfoils, with the stator vanes 12 attached to a casing 16 surrounding the compressor 10 and the rotating blades 14 attached to a rotor 18 inside the compressor 10. In this manner, the stator vanes 12 direct the airflow entering the compressor 10 onto the following stage of rotating blades 14 to progressively impart kinetic energy to the working fluid (air) to bring it to a highly energized state.

Figure 2:
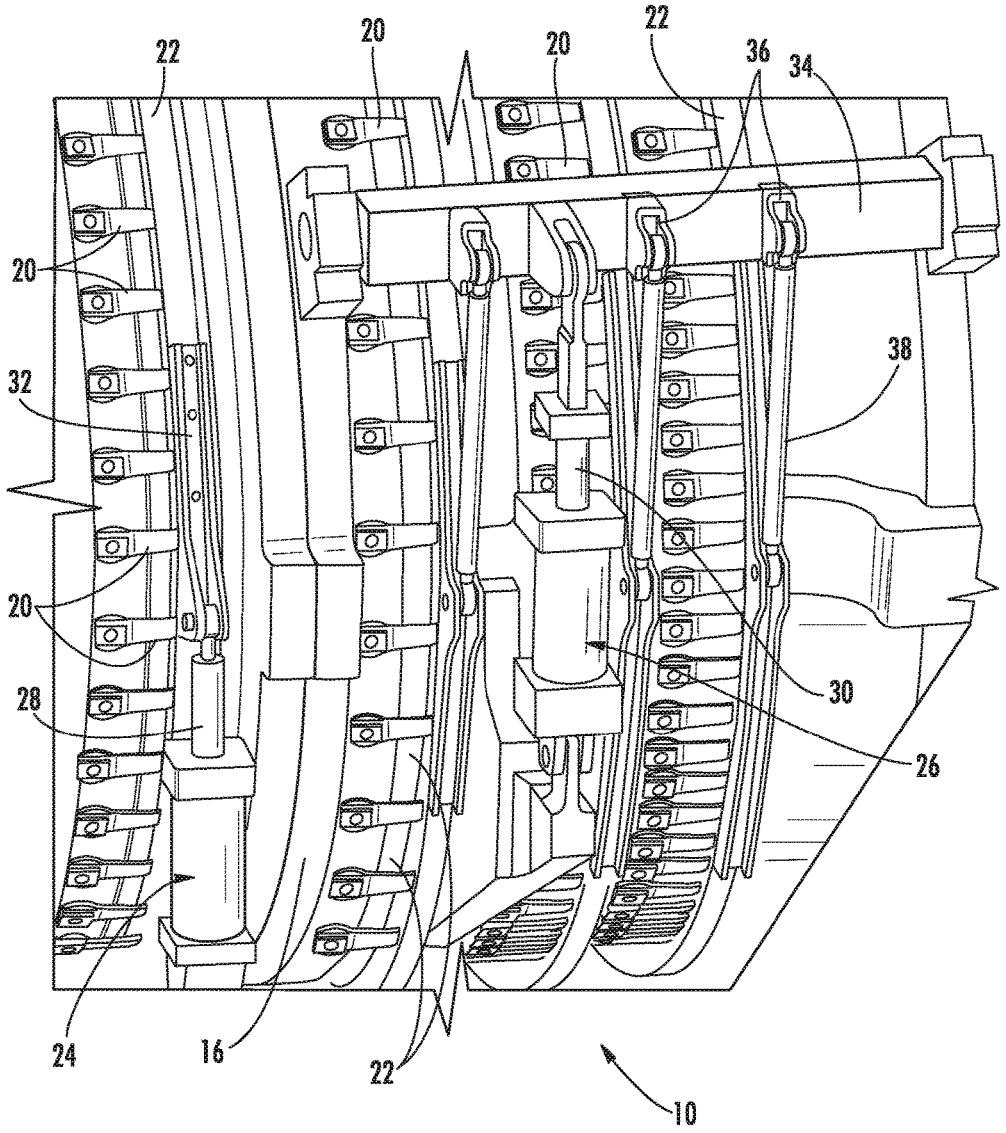
FIG. 2 is a perspective view of the compressor shown in FIG. 1.

FIG. 2 provides a perspective view of the compressor 10 shown in FIG. 1. As shown in FIGS. 1 and 2, each stator vane 12 may extend through the casing 16 and fixedly connect to a vane arm 20 outside of the casing 16. The vane arms 20 in each stage may in turn connect to a member 22, such as a unison ring 22 as shown in FIG. 2, to synchronize the movement of the vane arms 20 in each stage. Rotation or movement of the member or unison ring 22 about the casing 16 moves the associated vane arms 20, thus changing the position of the stator vanes 12 inside the casing 16.

The compressor 10 may further include first means 24 and second means 26 for separately and/or independently adjusting the position of the stator vanes 12 in various stages. For example, as shown in FIG. 2, the first means 24 may be connected to a plurality of stator vanes 12 in a first stage of the compressor 10, and the second means 26 may be connected to a plurality of stator vanes 12 in one or more subsequent stages. The first and/or second means 24, 26 may comprise any suitable electrical, mechanical, or electromechanical device(s) known to one of ordinary skill in the art for moving one component with respect to another. For example, the first and/or second means 24, 26 may comprise a threaded engagement, a ratchet and pawl assembly, a geared mechanism, and/or one or more springs connected to the vane arms 20 and/or members 22 to move the associated stator vanes 12. Alternately or in addition, as shown in FIG. 2, the first and/or second means 24, 26 may comprise an actuator, such as a hydraulic, pneumatic, or electric piston or motor, engaged with the associated plurality of stator vanes 12. The actuator may extend or retract to adjust the position of the stator vanes 12, as desired.

In the particular embodiment shown in FIG. 2, a first actuator 28 is engaged with a plurality of stator vanes 12 in the first stage, and a second actuator 30 is engaged with a plurality of stator vanes 12 in the second, third, and fourth stages. The first actuator 28 connects to a bridge 32 which in turn is engaged with the member or unison ring 22 and the vane arms 20. In this manner, extension or retraction of the first actuator 28 moves the bridge 32, unison ring 22, and vane arms 20 to adjust the position of the stator vanes 12 in the first stage. A bar 34 couples the second actuator 30 to one or more stages of stator vanes 12. For example, as shown in FIG. 2, fittings 36, turnbuckles 38, and bridges 32 may be used to connect the second actuator 30 to each stage of stator vanes 12 through the bar 34, the member 22, and vane arms 20. Extension or retraction of the second actuator 30 rotates the bar 30 which in turn moves the turnbuckles 38, bridges 32, members 22, and vane arms 20 to adjust the position of the stator vanes 12. The length of the fitting 36 and/or turnbuckle 38 for each stage may be adjusted to vary the amount of movement transmitted by the second actuator 30 through the bar 34 to each stage of stator vanes 12. In this manner, the first actuator 28 may adjust the position of the stator vanes 12 in the first stage of the compressor 10 independent of the position of the stator vanes 12 in the downstream stages. Similarly, the second actuator 30 may adjust the position of the stator vanes 12 in the one or more subsequent stages independent of the position of the stator vanes 12 in the first stage.

Figure 3:
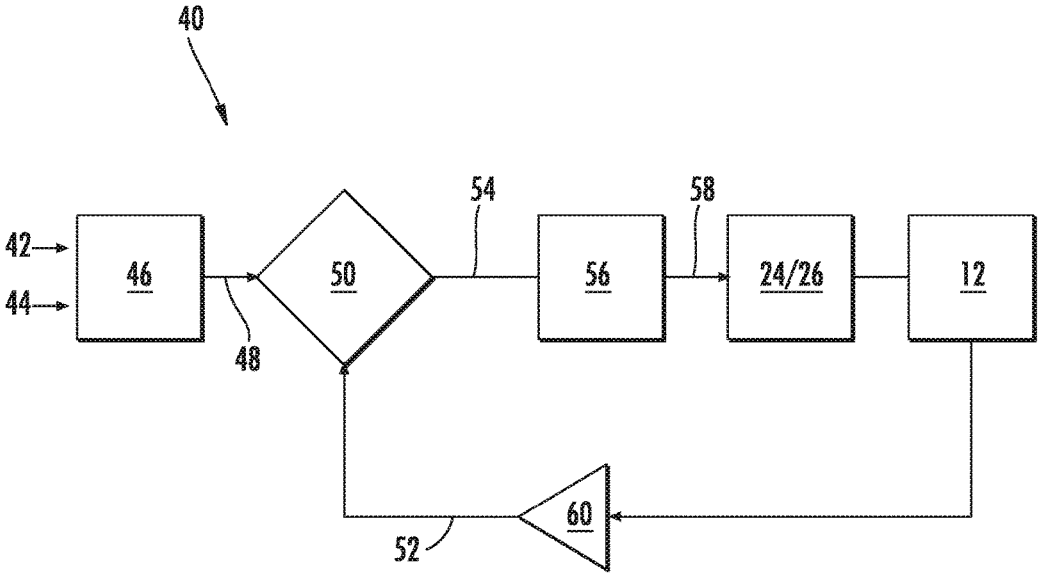
FIG. 3 is a simplified block diagram of a control system according to one embodiment of the present invention.

FIG. 3 provides a simplified block diagram of a control system 40 suitable for independently operating the first or second means 24, 26 shown in FIGS. 1 and 2. The control system 40 receives a speed signal 42 and an operating mode signal 44 as input parameters. The speed signal 42 reflects of the speed of the compressor 10, and the operating mode signal 44 reflects the particular operating mode of the compressor 10. For example, the compressor 10 may be operated in start up, shutdown, wash down, turndown, or another operating mode, with each operating mode having its own preprogrammed schedule of speed and associated stator vane 12 positions for each stage of stator vanes 12. At block 46, the control system 40 generates a position command 48 that reflects a pre-programmed position for the stator vanes 12 based on the speed signal 42 and the operating mode signal 44. At block 50, the control system 40 compares the position command 48 with a feedback signal 52 to produce an error signal 54 that reflects the amount of adjustment needed to move the stator vanes 12 to the pre-programmed position. At block 56, a control gain may be applied to the error signal 52 to adjust the error signal 52 according to the particular stage of stator vanes 12 being controlled, and the resulting combination may be provided as a control signal 58 to the first or second means 24, 26 to re-position the stator vanes 12. The actual position of the stator vanes 12 being controlled may be measured by a linear position sensor 60, such as, for example an LVDT position sensor, to provide the feedback signal 52.

Figure 4:
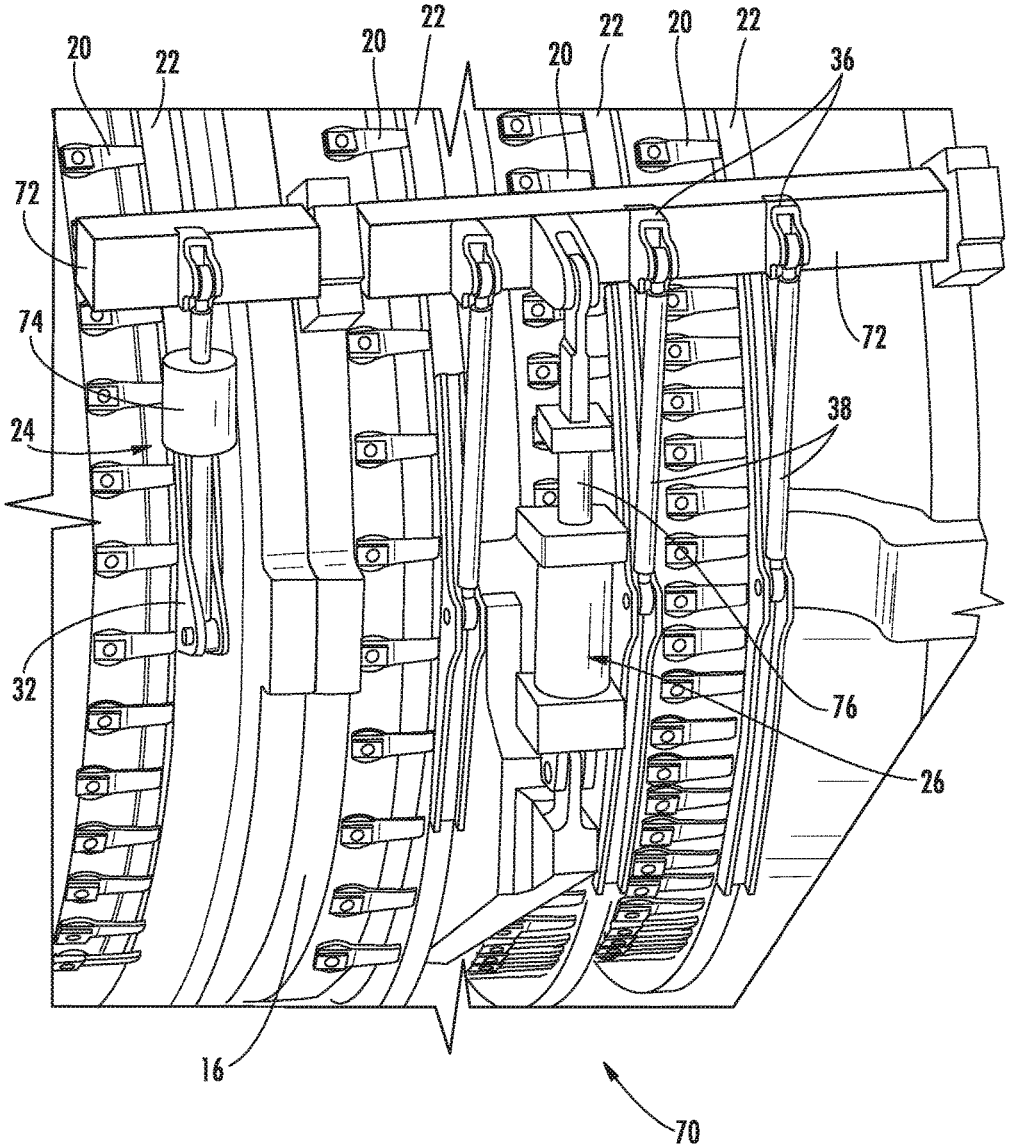
FIG. 4 is a perspective view of a compressor according to an alternate embodiment of the present invention.

FIG. 4 provides a perspective view of a compressor 70 according to an alternate embodiment of the present invention. The compressor 70 again includes alternating stages of stator vanes 12 and rotating blades 14 as previously described with respect to the embodiment shown in FIGS. 1 and 2. In addition, each stator vane 12 may again extend through the casing 16 and fixedly connect to vane arms 20 and members 22 outside of the casing 16 so that rotation or movement of the member 22 about the casing 16 moves the associated vane arms 20, thus changing the position of the stator vanes 12 inside the casing 16.

In the particular embodiment shown in FIG. 4, a connector 72 is engaged with both the first and second means 24, 26. The first and/or second means 24, 26 may again comprise any suitable electrical, mechanical, or electromechanical device(s) known to one of ordinary skill in the art for moving one component with respect to another, as previously described with respect to the embodiment shown in FIG. 2. For example, the first and/or second means 24, 26 may comprise a threaded engagement, a ratchet and pawl assembly, a geared mechanism, one or more springs, and/or an actuator connected to the vane arms 20 and/or members 22 to move the associated stator vanes 12.

As shown in FIG. 4, the connector 72 may be engaged with both a first actuator 74 and a second actuator 76. The first actuator 74 may be engaged with a plurality of stator vanes 12 in the first stage through the bridge 32, member 22, and vane arms 20. The second actuator 76 may be engaged with a plurality of stator vanes 12 in downstream stages as previously described with respect to the embodiment shown in FIG. 2. Specifically, the second actuator 76 may be engaged through the connector 72, fittings 36, turnbuckles 38, bridges 32, members 22, and vane arms 20 to each stage of stator vanes 12. Extension or retraction of the second actuator 76 rotates the connector 72 which in turn moves the turnbuckles 38, bridges 32, members 22, and vane arms 20 to adjust the position of the stator vanes 12 in the downstream stages. Rotation of the connector 72 also moves the first actuator 74 to adjust the position of the first stage stator vanes 12 connected to the first actuator 74. Alternately, or in addition, the first actuator 74 may be energized to reduce or increase the movement caused by the connector 72. In this manner, the first actuator 74 may adjust the position of the first stage stator vanes 12 separately from the position of the stator vanes 12 in the downstream stages. Similarly, the second actuator 76 may adjust the position of the stator vanes 12 in the downstream stages separately from the position of the stator vanes 12 in the first stage.

Figure 5:
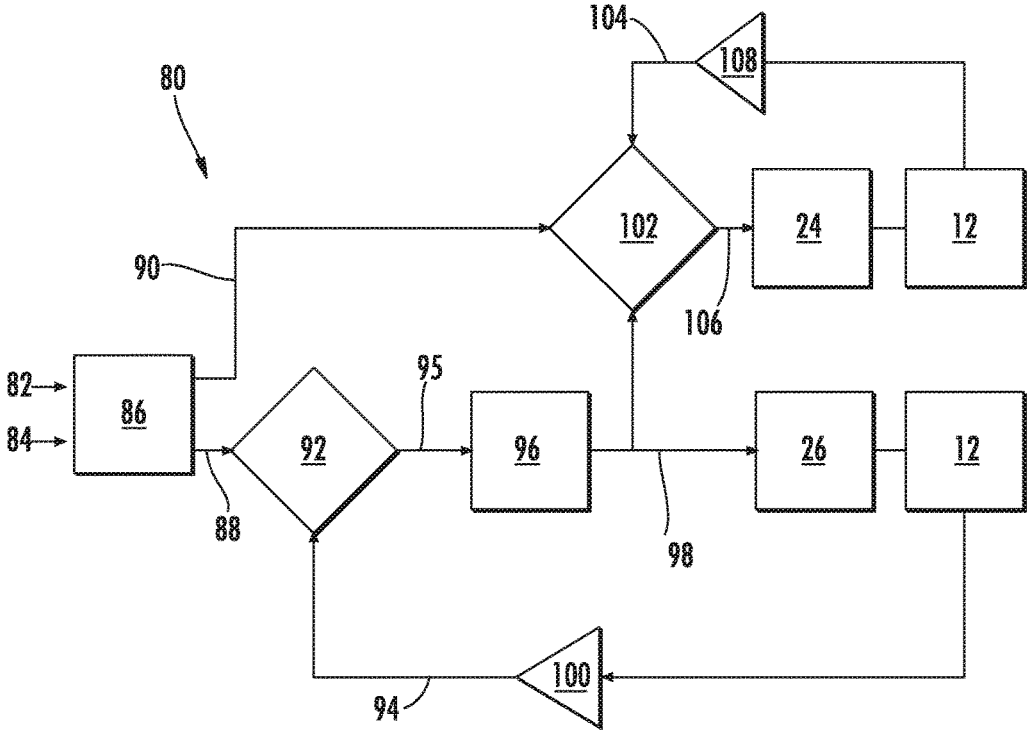
FIG. 5 is a simplified block diagram of a control system according to an alternate embodiment of the present invention.

FIG. 5 provides a simplified block diagram of a control system 80 suitable for separately operating both the first and second means 24, 26 shown in FIG. 4. The bottom portion of FIG. 5 controls the second means 26 and operates substantially similar to the control system 40 previously described with respect to FIG. 3. Specifically, the control system 80 receives a speed signal 82 and an operating mode signal 84 as input parameters. The speed signal 82 reflects of the speed of the compressor 70, and the operating mode signal 84 reflects the particular operating mode of the compressor 70. For example, the compressor 70 may be operated in start up, shutdown, wash down, turndown, or another operating mode, with each operating mode having its own preprogrammed schedule of speed and associated stator vane 12 positions for each stage of stator vanes 12.

At block 86, the control system 80 generates position commands 88, 90 that reflect pre-programmed positions for the downstream stator vanes 12 and first stage stator vanes 12, respectively, based on the speed signal 82 and the operating mode signal 84. At block 92, the control system 80 compares the position command 88 for the downstream stator vanes 12 with a feedback signal 94 for those stator vanes 12 to produce an error signal 95 that reflects the amount of adjustment needed to move the downstream stator vanes 12 to the pre-programmed position. At block 96, a control gain may be applied to the error signal 95 to adjust the error signal 95 according to the particular stage of stator vanes 12 being controlled, and the resulting combination may be provided as a control signal 98 to the second means 26 to re-position the downstream stator vanes 12. The actual position of the downstream stator vanes 12 may be measured by a linear position sensor 100, such as an LVDT position sensor to provide the feedback signal 94.

Substantially simultaneously, at block 102, the control system 80 combines the position command 90 for the first stage stator vanes 12, a feedback signal 104 for those stator vanes 12, and the control signal 98 provided to the second means 26 to determine what, if any, adjustment is needed for the position of the first stage stator vanes 12. The comparison results in an error signal 106 that reflects the amount of adjustment needed to move the first stage stator vanes 12 to the pre-programmed position, and the error signal 106 may be provided to the first means 24 to re-position the first stage stator vanes 12. The actual position of the first stage stator vanes 12 may be measured by a linear position sensor 108, such as, for example an LVDT position sensor, to provide the feedback signal 104.

The embodiments previously described with respect to FIGS. 1-5 may also provide a method for operating compressors 10, 70 that uncouples the positioning of stator vanes 12 in different stages. The method may include adjusting the position of a plurality of stator vanes 12 in one stage separately and/or independently from the position of a plurality of stator vanes 12 in one or more downstream stages. In particular, the method may include any combination of opening and closing adjustments to stator vanes 12 in different stages.

The system and methods disclosed herein are believed to provide several aerodynamic and control enhancements to existing compressor operating schemes that will improve compressor stability over a wide range of operating conditions, including startup/shutdown transients, off-line water wash, power turn down, and hot day output operations. For example, an anticipated benefit of various embodiments of the present invention may be the ability to clear compressor rotating stall at lower rotational speeds during the startups and to suppress the onset of compressor rotating stall to lower rotational speeds during the shutdowns. Minimizing the amount of time that the compressor experiences rotating stall during startup and shutdown operations reduces the vibratory stresses on the stator vanes 12 and rotating blades 14, thus enhancing the life and durability of the compressor.

Another anticipated benefit may be improved water ingestion during off-line water wash operations. Specifically, opening the first stage stator vanes 12 separately and/or independently from downstream stator vanes 12 may improve the ingestion of injected water wash solutions while avoiding compressor stalls. Conversely, during power turn down operations, closing the first stage stator vanes 12 separately and/or independently from the downstream stator vanes 12 may enhance the power turn down range by minimizing the compressor efficiency fall-off. Another anticipated benefit of embodiments within the scope of the present invention may be the ability to open the first stage stator vanes 12 separately and/or independently from the downstream stator vanes 12 to increase the airflow through the compressor during high ambient temperature days to compensate for the reduced density of the airflow associated with higher ambient temperatures.

Embodiments within the scope of the present invention may provide several mechanical benefits as well. For example, actuators that separately and/or independently position different-sized stator vanes 12 may have fewer joints and connections, reducing the cumulative manufacturing tolerances and wear associated with the actuators. The reduced cumulative manufacturing tolerances result in smaller vane angle errors. Alternately, the reduced cumulative manufacturing tolerances may allow larger individual tolerances without increasing the vane angle errors. In addition, the first and largest stage of stator vanes typically moves the farthest between extreme positions, and having one actuator control different sized stator vanes in different stages potentially creates a non-linear relationship with the smaller stator vanes in other stages that may result in larger vane angle errors. Dedicating an actuator to separately and/or independently adjust the position of the largest stage of stator vanes effectively isolates any non-linear relationship from the smaller stator vanes in other stages.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A compressor comprising:

a first plurality of single-panel stator vanes arranged in a first stage and connected to a first rotating member, wherein the first plurality of stator vanes comprises inlet guide vanes located upstream of a first stage of rotating blades, and wherein each of the first plurality of stator vanes has a first position and a first length;

a first movement-inducing device engaged with the first rotating member for adjusting the first position of each of the first plurality of stator vanes;

a second plurality of stator vanes arranged in two or more successive stages downstream of the first stage, each respective stage of the second plurality of stator vanes being connected to a respective rotating member and having a respective position, one of the two or more successive stages in the second plurality of stator vanes being adjacent the first plurality of stator vanes, the stator vanes in the one of the two or more successive stages having a second length less than the first length;

a bar connecting the respective rotating members of the two or more successive stages of stator vanes downstream of the first stage;

a second movement-inducing device engaged with the bar for adjusting, in unison, the relative positions of the second plurality of stator vanes in the two or more successive downstream stages;

a control system configured to receive a first input representing a speed of the compressor and a second input representing an operating mode of the compressor; to use the first input and the second input to separately generate a first position command for the second plurality of stator vanes and a second position command for the first plurality of stator vanes; to use the first position command to provide a first control signal to the second actuator to adjust, in unison, the relative positions of the second plurality of stator vanes; and to use the second position command in combination with the first control signal to provide a second control signal to the first actuator for adjusting the first position of the first plurality of stator vanes;

wherein the adjusting of the relative positions of the second plurality of stator vanes, as directed by the first control signal, is separate from and independent of the adjusting of the first position of the first plurality of stator vanes, as directed by the second control signal.

2. The compressor of claim 1, wherein each stator vane of the first plurality of stator vanes is connected to a vane arm, and wherein each vane arm is connected to the first rotating member, the first movement-inducing device being engaged with the first rotating member via a bridge.

3. The compressor of claim 1, wherein the second plurality of stator vanes is arranged in three successive downstream stages.

4. The compressor of claim 1, wherein each stator vane of the second plurality of stator vanes is connected to a vane arm, and wherein each vane arm in a respective stage of the two or more downstream stages is connected to the respective rotating member for the respective stage.

5. The compressor of claim 1, wherein the bar is located radially outward of the respective rotating members; and wherein the bar is engaged with the respective rotating members via bridges attached to the respective rotating members and turnbuckles attached, on first ends thereof, to the bridges and, on second ends thereof, to fittings attached to the bar.

6. The compressor of claim 1, further comprising a linear position sensor, the linear position sensor sensing at least one of the first position of the first plurality of stator vanes and the respective position of at least one stage of the second plurality of stator vanes, the linear position sensor providing a feedback signal to the control system.

7. The compressor of claim 1, wherein each of the first movement-inducing device and the second movement-inducing device is an actuator selected from the group consisting of a hydraulic actuator, a pneumatic actuator, and an electric actuator.

8. The compressor of claim 7, wherein each of the first movement-inducing device and the second movement-inducing device is an electric actuator.

9. A compressor comprising:

a first plurality of single-panel stator vanes arranged in a first stage and connected to a first unison ring, wherein the first plurality of stator vanes comprises inlet guide vanes located upstream of a first stage of rotating blades, and wherein each of the first plurality of stator vanes has a first position and a first length;

a first actuator engaged with the first unison ring for adjusting the first position of each of the first plurality of stator vanes;

a second plurality of stator vanes arranged in two or more successive stages downstream of the first stage, each respective stage of the second plurality of stator vanes being connected to a respective unison ring and having a respective position, one of the two or more successive stages of the second plurality of stator vanes being adjacent the first plurality of stator vanes, the stator vanes in the one of the two or more successive stages having a second length less than the first length;

a bar connecting the respective unison rings of the two or more successive stages of stator vanes downstream of the first stage;

a second actuator engaged with the bar for adjusting, in unison, the relative positions of the second plurality of stator vanes in the two or more successive downstream stages;

a control system configured to separately generate a first position command for the second plurality of stator vanes and a second position command for the first plurality of stator vanes; to use the first position command to provide a first control signal to the second actuator to adjust, in unison, the relative positions of the second plurality of stator vanes; and to use the second position command in combination with the first control signal to provide a second control signal to the first actuator for adjusting the first position of the first plurality of stator vanes;

wherein the adjusting of the relative positions of the second plurality of stator vanes, as directed by the first control signal, is separate from and independent of the adjusting of the first position of the first plurality of stator vanes, as directed by the second control signal; and wherein the adjusting of the first position of each of the first plurality of stator vanes and the adjusting of the relative positions of the second plurality of stator vanes includes any combination of opening and closing adjustments, the any combination of opening and closing adjustments comprising a first combination of opening the first plurality of stator vanes and closing the second plurality of stator vanes and a second combination of closing the first plurality of stator vanes and opening the second plurality of stator vanes.

10. The compressor of claim 9, wherein each stator vane of the first plurality of stator vanes is connected to a vane arm, and wherein each vane arm is connected to the first unison ring, the first actuator being engaged with the first unison ring via a bridge.

11. The compressor of claim 9, wherein the second plurality of stator vanes is arranged in three successive downstream stages.

12. The compressor of claim 9, wherein each stator vane of the second plurality of stator vanes is connected to a vane arm, and wherein each vane arm in a respective stage of the two or more downstream stages is connected to the respective unison ring for the respective stage.

13. The compressor of claim 9, wherein the bar is located radially outward of the respective unison rings; and wherein the bar is engaged with the respective unison rings via bridges attached to the respective unison rings and turnbuckles attached, on first ends thereof, to the bridges and, on second ends thereof, to fittings attached to the bar.

14. The compressor of claim 9, further comprising a linear position sensor, the linear position sensor sensing at least one of the first position of the first plurality of stator vanes and the respective position of at least one stage of the second plurality of stator vanes, the linear position sensor providing a feedback signal to the control system.

15. The compressor of claim 14, wherein the linear position sensor senses the respective position of at least one stage of the second plurality of stator vanes and provides the feedback signal to the control system, the feedback signal being combined with the first position command to provide the first control signal.

16. The compressor of claim 9, wherein each of the first actuator and the second actuator is an electric actuator.

17. The compressor of claim 9, wherein the control system is provided with a first input representing a speed of the compressor and a second input representing an operating mode of the compressor, the first input and the second input being used to generate the first position command and the second position command.

18. The compressor of claim 17, wherein the operating mode is one of start-up, shutdown, off-line water wash, turndown, and hot day output, each operating mode having its own preprogrammed schedule of associated positions for the first plurality of stator vanes and the second plurality of stator vanes.

* * * * *